United States Patent [19]

Cook

[11] 4,412,464

[45] Nov. 1, 1983

[54] COMBINATION CAN OPENING TOOL

[76] Inventor: Jeffrey J. Cook, 6533 N. Seventh Ave., Apt. 3, Phoenix, Ariz. 85013

[21] Appl. No.: 413,970

[22] Filed: Sep. 1, 1982

[51] Int. Cl.[3] ..... B67B 7/44

[52] U.S. Cl. ..... 81/3.1 R; 81/3.46 R; 7/151

[58] Field of Search ..... 81/3.46 R, 3.1 R, 3.4, 81/3.34; 7/151, 169; D8/18, 34, 33, 40; D3/61, 62, 64; 70/458

[56] References Cited

U.S. PATENT DOCUMENTS

| | | | |
|---|---|---|---|
| 2,734,204 | 2/1956 | Epstein | 7/152 |
| 3,459,075 | 8/1969 | Henderson | 81/3.34 |
| 3,656,375 | 4/1972 | Reed et al. | 81/3.46 R |
| 4,133,228 | 1/1979 | DePooter | 81/3.1 R |
| 4,207,781 | 6/1980 | Greenwood | 81/3.46 R |
| 4,253,352 | 3/1981 | O'Neal | 81/3.46 R |
| 4,309,921 | 1/1982 | Miller | 81/3.46 R |
| 4,373,223 | 2/1983 | Miller | 81/3.46 R |

FOREIGN PATENT DOCUMENTS

| | | | |
|---|---|---|---|
| 2508025 | 9/1976 | Fed. Rep. of Germany | 81/3.46 R |
| 2614991 | 10/1977 | Fed. Rep. of Germany | 81/3.46 R |

*Primary Examiner*—Roscoe V. Parker

*Attorney, Agent, or Firm*—Cahill, Sutton & Thomas

[57] ABSTRACT

A tool for opening scored closures in cans. One end of the tool is provided with hook means and fulcrum means for lifting and pulling away a ring manipulator for a tear-away scored closure. The opposite end of the tool is adapted to engage the manipulating member for a displaceable scored closure which remains attached to the can. The tool has associated therewith a key ring which slides in a slot in the tool to permit the ring to be moved away from the end of the tool selected for use.

5 Claims, 4 Drawing Figures

COMBINATION CAN OPENING TOOL

TECHNICAL FIELD

This invention relates to hand-held tools for opening cans having scored, displaceable closures in the lids of the cans.

BACKGROUND ART

Supposedly for the convenience of the consumer, most beverage cans today are equipped with a lid having a scored closure therein which can be manually displaced from the remainder of the lid to provide access to the contents. Such cans are often referred to as having a "pop-top", because of the sound characteristically emitted upon displacement of the closure. Two types of pop-top cans are most prevalent. In the first, a ring-like manipulating member is attached to the scored closure. The consumer grasps the ring member and by lifting and moving the ring member away from the can, removes the scored closure from the can lid. Another popular form of pop-top can has a scored closure which can be displaced inwardly of the can from the lid while remaining attached to the lid. This type of closure is manipulated by means of a lever which is attached to the closure and extends part way across the top surface of the lid.

In both forms of pop-top cans referred to above the manually actuated manipulating members lie in close proximity to the top surface of the lid prior to use and preferably do not protrude above the can rim to minimize interference with stacking and/or packaging of the can. In such a position both the ring-like member and the lever must be pried away from the top surface of the can in order to initiate displacement of the closure. For most people, this act can inflict pain and injury on the finger and/or fingernail used to pry the manipulating member away from the can lid. Repetitive opening of such cans, as is required of servers in commercial establishments, can inflict serious injury to the servers' finger.

These difficulties associated with manipulating closures for pop-top cans have, of course, been recognized by others. And a number of proposals have been made for tools to be used to manipulate the closures so that one's hand is not required to contact the closure manipulating member directly. U.S. Pat. Nos. 3,459,075, 3,656,375, 4,133,228, and 4,207,781 all disclose implements for opening pop-top cans having tear-away closures with ring-like manipulating members. Generally speaking, all of the implements disclosed in these patents are bulky and complex and therefore fairly expensive to manufacture. Above all, none of the implements there disclosed are truly suitable for being carried on one's person, say in a pocket on a keyring. And the implements disclosed in these four patents are especially adapted for opening the ring-type tear-away closure and are not suitable for assisting in opening cans having the closures which are merely displaced and remain attached to the can.

U.S. Pat. Nos. 4,253,352 and 4,309,921 disclose fairly simple straight forward implements for opening the latter type closure, but none of the devices there disclosed are capable of actuating the tear-away closures. Moreover, the implements disclosed in these two patents are intended to be fabricated from metal, with the result that both the material costs and manufacturing costs tend to be high in comparison with injection molded plastic implements.

DISCLOSURE OF THE INVENTION

The tool of this invention is a compact, simple implement capable of being inexpensively produced in volume as an injection molded plastic item and of a size and configuration to be comfortably carried in the pocket of a person's garment. The tool has a body made a an elongated flat strip of plastic material. One end of the tool body has formed therein a hook member with an opening through one of the narrow edges of the body. Spaced from this hook member away from this one end and on a broad face of the body is a protuberance. When this end of the tool is inserted through the ring member of a pull away closure, the tool is used first, to pry the ring away from the can top using the protuberance as a fulcrum; thereafter the tool is rotated 90° so that the ring member moves into the eye of the hook and is retained there as the tool is moved away from the can to separate the closure from the can lid. Formed in the other end of the body is a recess for receiving the lever manipulating member of a pop-top can with a closure that remains in place. There are no pronounced sharp members projecting from the tool which might injure the hand of the user or interfere with carrying the tool in the user's pocket.

The tool may also be adapted for use in combination with a key ring and in this embodiment has an elongated slot in the tool body near one longitudinal edge for receiving the key ring. The purpose of the slot is to allow the ring to slide from one location to another away from the end of the tool body having the opening implement that the user desires to employ.

BEST MODE FOR CARRYING OUT THE INVENTION

Figure 1:
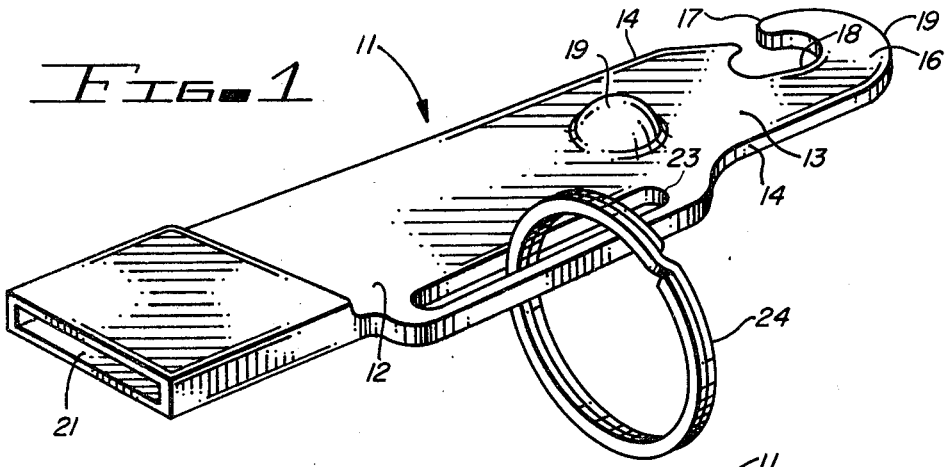
FIG. 1 is a perspective view of a can opening tool constructed in accordance with the invention.

FIG. 1 illustrates the can opening tool of this invention in its entirety. The tool is identified generally by reference numeral 11. The tool preferably comprises an elongated flat body 12 having opposing broad faces 13 and opposing thin edges 14. One end of body 12 is shaped to provide a hook member 16 with an opening 17 through one edge 14 of the body providing access to an eye 18 of the hook member.

Projecting from one face 13 of tool body 12 is a protuberance 19 which, as explained hereinafter, functions as a fulcrum member for the tool. The tool body 12 preferably tapers slightly in thickness from one end to the other with the thinest region occurring at the hook member 16 at one end thereof. This end of the body is also preferably chamfered as indicated at 19 to facilitate insertion of the tool initially beneath the ring-like manipulating member of a tear-away can closure.

The opposite end of the elongated tool body 12 is of slightly increased thickness and is shaped to provide a slot-like opening 21 to an elongated socket 22 extending inwardly from that end of the body.

The tool body 12 is also preferably shaped to provide an elongated slot 23 extending longitudinally of the tool body adjacent one edge 14 of the body.

Slot 23 receives a key ring 24 and permits the ring to move longitudinally along the tool 11 so that it may be displaced away from that end of the tool which is selected for use.

Figure 2:
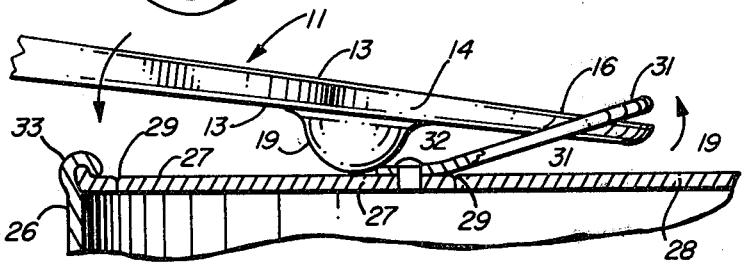
FIG. 2 is a partial side view of the tool of FIG. 1 illustrating use of the tool to lift the ring-like manipulating member of a tear-away closure for a can which is shown in fragmentary sectional elevation.
Figure 3:
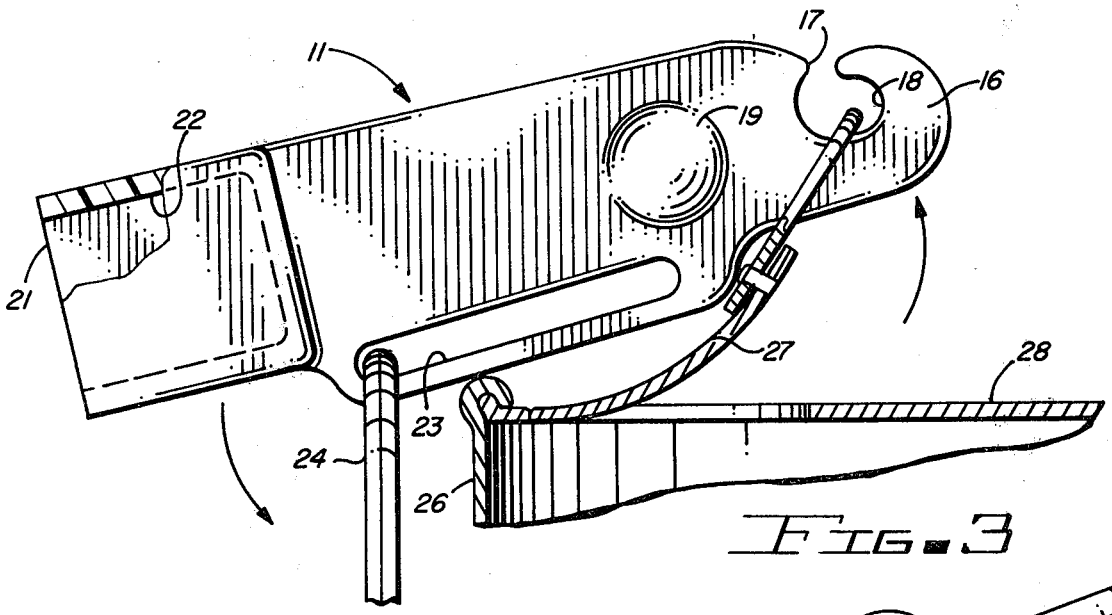
FIG. 3 is another view of the tool illustrating the manner in which the tool is used to detach a tear-away closure from a can.

FIGS. 2 and 3 illustrate the manner in which the tool is utilized to open a pop-top can 26 having a tear-away scored closure 27 in the lid 28 of the can. Closure 27 is outlined by a continuous score line 29 produced by means of a die to provide a line of weakness in the lid 28 to permit the closure 27 to be separated from the lid. Closure 27 is actuated by a manipulating member 31 which in this type of closure normally has the configuration of a ring capable of receiving the finger of a human. Manipulating member 31 is secured to one end of scored closure 27 by suitable fastening means, such as a rivet 32.

Manipulating member 31 prior to opening the can normally lies flush against the top surface of the lid 28 and usually beneath the upper edge of the can rim 32. In this position, manipulating member 31 does not interfere with stacking or packaging of the can. However, the flush positioning of manipulating member 31 within the confines of the can rim 32 makes the ring-like manipulating member 31 very difficult to lift and grasp. This act in opening the can can prove to be painful for the person who attempts to pry the manipulating member up with the end of his finger or his fingernail and can be particularly troublesome when one has to open large numbers of cans within a short space of time.

To open this type of pop-top can with tool 11, the user inserts that end of the tool having the hook member 16 therein through ring-like member 31 and beneath one portion thereof opposite the part of the ring-like member attached to closure 27 at rivet 32. The relatively thin thickness of tool body 12 at this end and the chamfer 19 at the end of the tool makes this act of insertion relatively easy. The tool is inserted in the position shown in FIG. 2 with the protuberance 19 on one face thereof projecting downwardly into contact with the top surface can lid 28. The opposite end of the tool is then manually moved downwardly, tilting the tool body 12 on fulcrum protuberance 19 so that the tool acts as a first class lever to pry manipulating member 31 upwardly. This action moves manipulating member 31 through an arc sufficient to raise the member a short distance above the top surface of the can lid 29 and to break the initial portion of the score line 29 at the end of closure 27 which is secured to manipulating member 31.

This initial "popping" of the tear-away closure 27 places a considerable strain on the finger and fingernail of a person opening the can without the aid of tool 11. With the tool, however, the person's finger does not contact the manipulating member 31 at all, and the mechanical advantage afforded by the lever action of tool 11 requires the person to exert very little force to open the can.

Following initial breakage of score line 29 and relief of gas pressure within the container 26, closure 27 is separated from the can by simply pulling on the ring-like manipulating member 31. Instead of using one's finger for this purpose, the user of tool 11 simply rotates the body of the tool about its longitudinal axis through approximately a 90° angle so that ring-like manipulating member 31 can pass through opening 17 into the eye 18 of hook member 16 of the tool. Thereafter, the user draws the tool away from the can with the manipulating member 31 secured in the hook member 16 to pull the remainder of closure 27 free of the can lid 28. This action is illustrated in FIG. 3 which also shows the location of the key ring 24 at one extremity of slot 23 away from the hook member 16 being used to open the can. In this position ring 24 is out of the way of the portion of the tool 11 being used.

Figure 4:
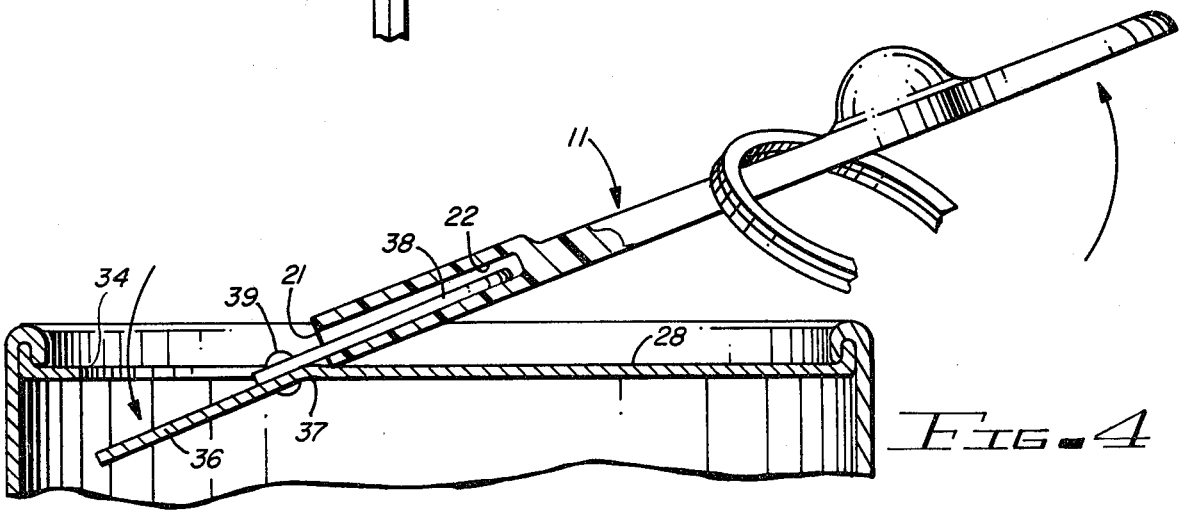
FIG. 4 is a side view of the tool, partially in section, illustrating the use of the tool to manipulate a displaceable closure which remains attached to the can, with the can being shown in fragmentary sectional elevation.

FIG. 4 illustrates use of the other end of the tool 11 to open a scored closure which remains attached to the can lid 28 after opening. In this type of pop-top can construction, the score line 34 is not continuous, but defines a closure 36 which can be displaced downwardly from the can lid 28 but has a tab-like portion 37 which remains connected to the main body of the lid 28. This type of closure is actuated by means of a manipulating lever 38 which is secured to closure 36 by suitable means such as a rivet 39.

As shown in FIG. 4, the tool 11 is used to open the pop-top closure which remains attached to the lid 28 by sliding that end of the tool 11 having opening 21 therein over the manipulating level 38 of the closure so that lever 38 is received within socket 22 of the tool. The tool is thereafter lifted to pivot lever 38 and closure 36 about connecting tab 37 to displace closure 36 inwardly of the can beneath lid 28. This type of closure usually permits lever 38 to be pressed back against the top surface of lid 28 without reclosing closure 36.

From the foregoing, it should be apparent that this invention provides a convenient and effective tool for opening two of the most prevalent types of pop-top beverage cans. The tool itself is preferably molded in one piece of relatively lightweight plastic material, such as high impact polystyrene or polycarbonate. Although size is not a critical factor so far as performance of the tool is concerned, tools as small as approximately three and three-quarter inches in length and approximately one inch in overall width give satisfactory performance. The small size of the tool coupled with its lightweight and lack of any sharp appendages, or projections, permits the tool to be easily and comfortably carried in the pocket of a garment and even carried on a key ring as has been previously discussed.

What is claimed is:

1. A tool for opening cans having a lid including a scored closure adapted to be displaced from the remainder of the lid to provide an opening in the lid and having a member disposed at the outer surface of the lid for manipulating said closure, said tool comprising an elongated body, said body having a hook member formed at one end of the body, said hook member opening toward one side of said body for receiving a ring-like manipulating member of a scored closure adapted to be pulled away from the remainder of the lid by the manipulating member, said body further having a protuberance thereon spaced from said hook member and projecting in a direction generally at a right angle to the direction of said hook member opening, said tool in use being adapted to have its said one end of the body inserted through said ring-like manipulating member and moved about said protuberance as a fulcrum to lift said manipulating member and then rotated to cause the manipulating member to enter said hook member opening, whereby movement of the tool away from said can thereafter pulls said manipulating member and said scored closure away from the lid of the can.

2. A tool as set forth in claim 1 wherein said body has means provided at the opposite end thereof for engaging a manipulating member of a scored closure adapted to be displaced from, but remain attached to the remainder of the lid, each end of said body serving as a handle when the opposite end is in use.

3. A tool as set forth in claim 2 wherein said body has an elongated slot running lengthwise thereof and a key ring passing through said slot.

4. The combination of a key ring and a tool for opening scored closures for cans, said tool comprising an elongated body having means at one end thereof for pulling away closures and means at the other end thereof for opening displaceable closures which remain attached to the can and means providing an elongated slot in said body and running lengthwise thereof for receiving said key ring, the arrangement being such that said ring can be moved in said slot along the body of the tool away from the end of the body having the opening means selected for use.

5. A tool for opening cans having a lid including a scored closure adapted to be pulled away from the remainder of the lid and a ring member attached to said closure for manipulating the closure, said ring member being positioned flat against the outer surface of said lid, said tool comprising an elongated planar body having upper and lower faces and opposed edges, means providing a hook member near one end of said body, said hook member opening to one edge of the tool body, and a protuberance on one face of the tool body spaced from said one end of the body beyond said hook member, said tool in use being adapted to have the said one end of its body inserted through said ring member and moved about said protuberance as a fulcrum to lift said ring member away from the surface of said lid, said tool when rotated receiving and retaining said ring member in the opening of said hook member, whereby movement of the tool away from said can thereafter pulls said ring member and said closure away from the lid of the can.

* * * * *